US012410674B2

(12) United States Patent
Hiorth

(10) Patent No.: US 12,410,674 B2
(45) Date of Patent: Sep. 9, 2025

(54) DOWNHOLE MILLABLE PERMANENT PLUG AND METHOD FOR SETTING A DOWNHOLE MILLABLE PERMANENT PLUG

(71) Applicant: Interwell Norway AS, Hafrsfjord (NO)
(72) Inventor: Espen Hiorth, Trondheim (NO)
(73) Assignee: Interwell Norway AS, Hafrsfjord (NO)

( * ) Notice: Subject to any disclaimer, the term of this patent is extended or adjusted under 35 U.S.C. 154(b) by 0 days.
(21) Appl. No.: 18/568,120
(22) PCT Filed: Jun. 2, 2022
(86) PCT No.: PCT/EP2022/065056
§ 371 (c)(1),
(2) Date: Dec. 7, 2023
(87) PCT Pub. No.: WO2022/268473
PCT Pub. Date: Dec. 29, 2022
(65) Prior Publication Data
US 2024/0263537 A1 Aug. 8, 2024
(30) Foreign Application Priority Data
Jun. 25, 2021 (NO) ..... 20210807
(51) Int. Cl.
*E21B 33/12* (2006.01)
(52) U.S. Cl.
CPC ..... *E21B 33/1204* (2013.01)
(58) Field of Classification Search
CPC .... E21B 33/1204; E21B 33/008; E21B 36/04; E21B 36/008
See application file for complete search history.

(56) References Cited

U.S. PATENT DOCUMENTS 6,828,531 B2 * 12/2004 Spencer ..... E21B 36/04 166/60
6,923,263 B2 * 8/2005 Eden ..... C09K 8/42 166/179

(Continued)

FOREIGN PATENT DOCUMENTS

EP 2956614 A2 12/2015
GB 2561255 A 10/2018

(Continued)

OTHER PUBLICATIONS

International Search Report issued in corresponding International Application No. PCT/EP2022/065056, mailed on Aug. 11, 2022 (5 pages).

(Continued)

*Primary Examiner* — D. Andrews
(74) *Attorney, Agent, or Firm* — Osha Bergman Watanabe & Burton LLP

(57) ABSTRACT

A downhole millable permanent plug, which permanently seals a downhole well, includes a mandrel, first and second sealing elements, a metal body, and a setting system. The mandrel has a longitudinal axis. The first sealing element is provided radially outside of the mandrel. The second sealing element is provided radially outside of the mandrel at a distance from the first sealing element. The metal body is provided radially outside of the mandrel between the first sealing element and the second sealing element. The setting system includes a heater for melting the metal body. The permanent well plug is configured to be in the following states: a run state, in which the first sealing element and the second sealing element are radially retracted; an intermediate state, in which the first sealing element and the second sealing element are radially expanded into contact with the well; and a set state, in which the metal body has been melted by the heater and subsequently solidified into contact with the well.

18 Claims, 8 Drawing Sheets

(56) References Cited

U.S. PATENT DOCUMENTS

Figure 1A:
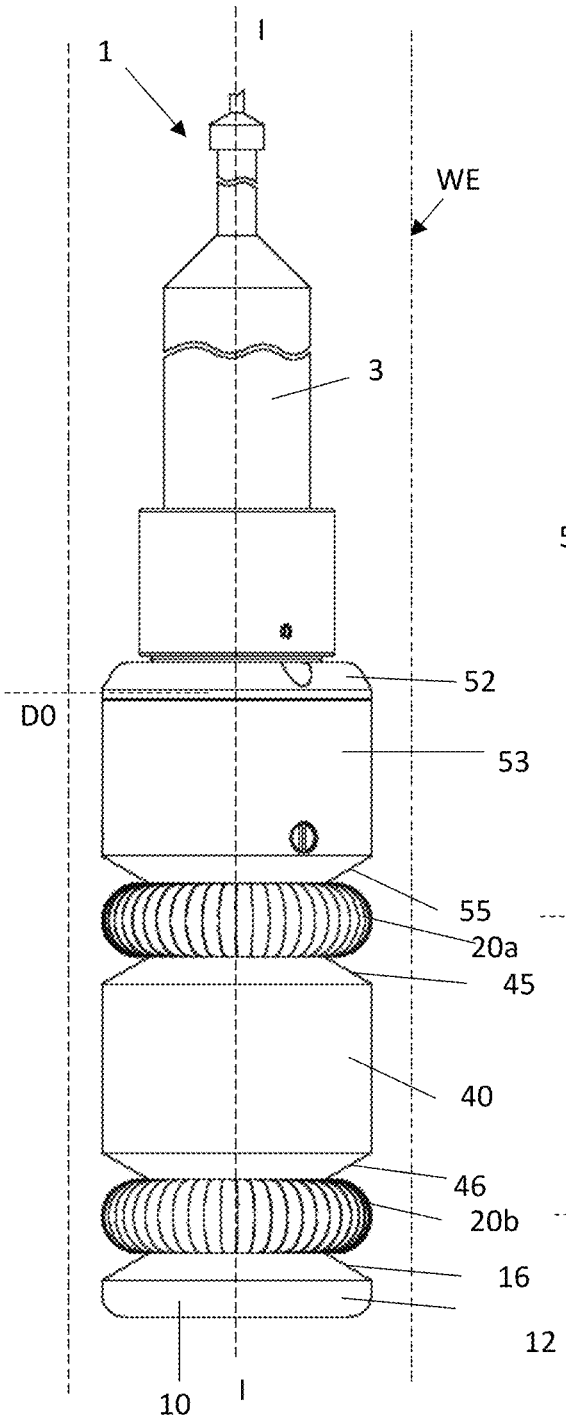

| | | | | |
|---|---|---|---|---|
| 9,394,757 | B2 * | 7/2016 | Lowry | E21B 33/13 |
| 10,760,374 | B2 * | 9/2020 | Hearn | H10B 43/40 |
| 2010/0155085 | A1 * | 6/2010 | Spencer | E21B 33/12 166/386 |
| 2014/0190684 | A1 | 7/2014 | Hiorth | |
| 2015/0034317 | A1 * | 2/2015 | Skjold | E21B 36/008 166/288 |
| 2019/0195062 | A1 | 6/2019 | Espe et al. | |
| 2020/0056444 | A1 | 2/2020 | Benzie et al. | |
| 2022/0364434 | A1 * | 11/2022 | Olsen | E21B 33/12 |

FOREIGN PATENT DOCUMENTS

| | | | |
|---|---|---|---|
| NO | 334009 | B1 | 11/2013 |
| NO | 335473 | B1 | 12/2014 |
| WO | 03/083255 | A1 | 10/2003 |
| WO | 2011/073610 | A2 | 6/2011 |
| WO | 2019/151870 | A1 | 8/2019 |
| WO | 2021/043582 | A1 | 3/2021 |

OTHER PUBLICATIONS

Written Opinion issued in corresponding International Application No. PCT/EP2022/065056, mailed on Aug. 11, 2022 (8 pages).
Search Report issued in counterpart Norwegian Patent Application No. 20210807 mailed on Jan. 21, 2022 (2 pages).

* cited by examiner

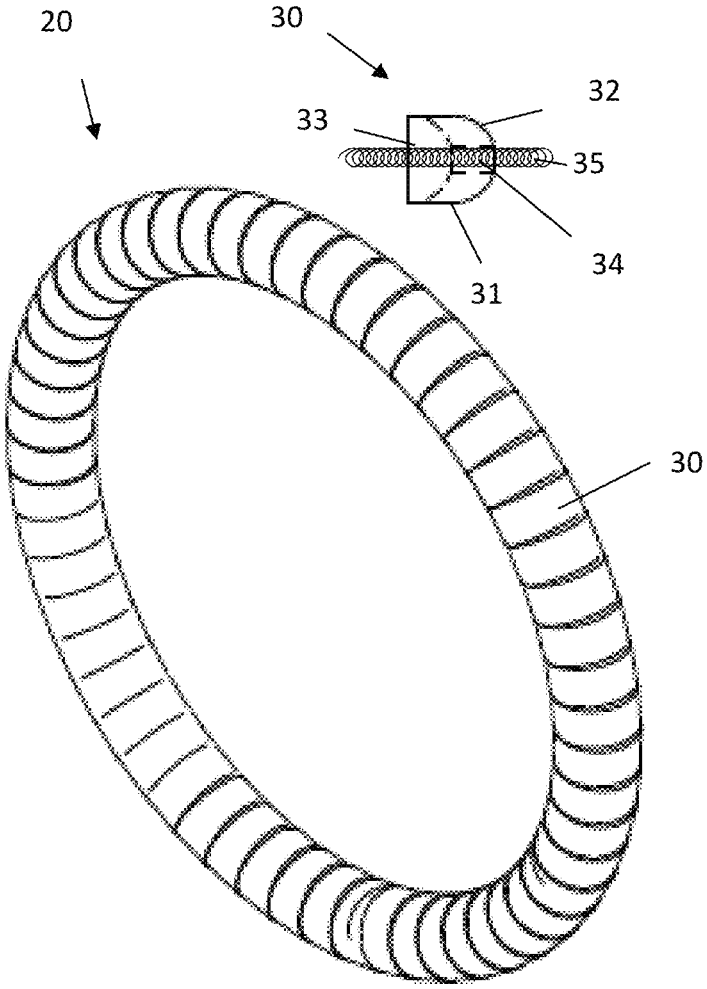
Fig. 4b
Fig. 4a
Fig. 4c
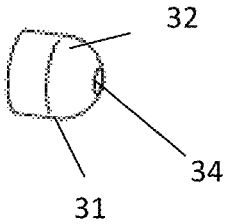
Fig. 4d
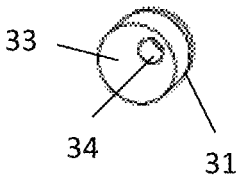

DOWNHOLE MILLABLE PERMANENT PLUG AND METHOD FOR SETTING A DOWNHOLE MILLABLE PERMANENT PLUG

FIELD OF THE INVENTION

The present invention relates to a downhole millable permanent plug for permanently sealing of a downhole well. The present invention also relates to a method for setting a downhole millable permanent plug in a downhole well.

BACKGROUND OF THE INVENTION

Different types of downhole plugs are known. Their purpose is typically to seal off a downhole bore (for example a casing or a production tubing) during a well operation. Some downhole plugs are retrievable, i.e. after a period of time, a retrieving tool are used to retrieve the plug to topside again. Other downhole plugs are permanent plugs. One permanent plug is disclosed in NO 334009.

If there is a need to remove a permanent plug, a milling operation is required to mill the permanent plug into smaller fragments. A common problem with such a milling operation is that parts of the plug may start to rotate together with the milling tool, effectively preventing milling to take place.

Another permanent plug is disclosed in NO 335473. Here, rotation of the inner mandrel in the set state, typically caused by the milling tool, is bringing a mandrel section of the mandrel to a locked state, in which further rotation of the inner mandrel is prevented. This plug must typically be made of steel, and therefore has a higher cost than other permanent plugs, which typically are made of cheaper materials such as cast iron, cast steel etc.

In plugging and abandonment (P&A) operations, permanent plugs are initially set in the well. Then, molten bismuth may be supplied above the permanent plug. Bismuth has expanding properties, i.e. volume of the metal is larger when solidified than when molten. Hence, solidified bismuth serves as an additional barrier above the permanent plug. Typically, a relatively large amount of bismuth is required, which in turn require a relatively large heater in the well to melt the bismuth at the desired location in the well. According to the report "European Commission, Study on the EU's list of Critical Raw Materials—Final Report (2020)", bismuth is considered to be a critical raw material. Hence, one purpose of the present invention is to be able to reduce the amount of bismuth when providing a barrier in a well.

The object of the present invention is to provide an alternative permanent plug which is easy to mill out by a milling operation.

SUMMARY OF THE INVENTION

The present invention relates to a downhole millable permanent plug for permanently sealing of a downhole well, wherein the permanent plug comprises:

- a mandrel having a longitudinal axis;
- a first sealing element provided radially outside of the mandrel;
- a second sealing element provided radially outside of the mandrel at a distance from the first sealing element;
- a metal body provided radially outside of the mandrel between the first sealing element and the second sealing element;
- a setting system comprising a heater for melting the metal body;

wherein the permanent well plug is configured to be in the following states:

- a run state, in which the first sealing element and the second sealing element are radially retracted;
- an intermediate state, in which the first sealing element and the second sealing element are radially expanded into contact with the well;
- a set state, in which the metal body has been melted by the heater and subsequently solidified into contact with the well.

The solidified metal will prevent that some parts of the well tool can be rotated relative to other parts of the well tool during a milling operation. Hence, the well tool is considered millable.

In one aspect, the setting system comprises:

- a first spring support secured to the mandrel;
- a second spring support longitudinally displaceable relative to the mandrel;
- a spring for moving the second spring support relative to the first spring support;

wherein the second spring support is releasably secured to the mandrel in the run state;

wherein the second spring support is released in the intermediate state, causing the second spring support to be longitudinally displaced a first distance from the first spring support relative to the mandrel;

wherein the first sealing element and the second sealing element are radially expanded into contact with the well by the longitudinal displacement of the second spring support.

Alternatively, the first sealing element and the second sealing element are radially expanded into contact with the well by means of a setting tool.

In one aspect, the spring is biased between the first spring support and the second spring support in the run state.

In one aspect, the second spring support is moved towards the first sealing element in the intermediate state. In one aspect, the second spring support is moved towards the second sealing element in the intermediate state.

In one aspect, the second spring support is allowed to be longitudinally displaced a second distance from the first spring support relative to the mandrel when the metal body has been melted by the heater, wherein the second distance is longer than the first distance.

In one aspect, the first sealing element is provided between a first wedging surface and a second wedging surface and wherein relative longitudinal displacement between the first wedging surface and the second wedging surface towards each other is radially expanding the first sealing element.

In one aspect, the first wedging surface is provided on the second spring support and wherein the second wedging surface is provided on the metal body.

In one aspect, the second sealing element is provided between a third wedging surface and a fourth wedging surface, and wherein relative longitudinal displacement between the third wedging surface and the fourth wedging surface towards each other is radially expanding the second sealing element.

In one aspect, the third wedging surface is provided on the metal body, wherein the fourth wedging surface is provided on the mandrel and wherein the metal body is longitudinally displaceable relative to the mandrel.

Alternatively, the fourth wedging surface may be provided on a further spring support biased by a further spring relative to the mandrel. In such a case, the metal body may be fixed relative to the mandrel. As such an embodiment comprises two springs, it is considered more complex.

In one aspect, the second spring support is releasably secured to the mandrel by means of a meltable locking element in the run state.

In one aspect, the setting system comprises an auxiliary heater for melting the meltable locking element.

In one aspect, the metal body comprises a metal or metal alloy whose volume is larger when solidified than when molten.

In other words, the density of the metal or metal alloy in liquid form is larger than the density of the metal or metal alloy in solid form. Hence, the metal will expand during solidification.

In one aspect, the metal is bismuth or the metal alloy is a bismuth alloy.

Alternatively, the metal or metal alloy comprises germanium and/or gallium.

In one aspect, the metal body comprises a metal having or metal alloy having a melting temperature lower than the melting temperature of the mandrel metal.

In one aspect, the first sealing element and/or the second sealing element comprise a plurality of thimble-shaped elements inserted into each other to form a torus.

In one aspect, the thimble-shaped elements are made of a heat resistant metal, a heat resistant ceramic or another suitable heat-resistant material.

In one aspect, the thimble-shaped elements may be coated. The thimble-shaped elements may be coated with a high-temperature resistant polymer.

In one aspect, each of the thimble-shaped elements comprises a through bore, where the thimble-shaped elements are connected to each other by means of a connection element inserted through the respective bores.

In one aspect, the connection element is a wire. The connection element may be elastic for biasing the sealing element towards the radially retracted state. In one aspect, the connection element is a spiral spring. In one aspect, the connection element is a spiral spring for biasing the sealing element towards the radially retracted state.

In one aspect, the first sealing element and/or the second sealing element comprises a torus-shaped coiled spring, preferably a torus-shaped canted coiled spring.

In one aspect, the heater and/or the auxiliary heater are integrated in the mandrel.

In one aspect, the heater and/or the auxiliary heater are electric heaters.

Alternatively, the heater is a chemical heater, for example a heater heated by means of a exothermic oxidation-reduction reaction, for example a thermite reaction.

According to the above, a metal-to-metal seal is provided between the solidified metal and a metal pipe forming the downhole well. A metal-to-metal seal is also provided between the mandrel and the solidified metal. Hence, no elastomeric sealing elements, no O-rings etc. are needed as part of the barrier formed by the permanent plug.

According to the above, a relatively small amount of bismuth is used.

According to the above, the expanding properties of the metal during solidification will also exert a force from the outer surface of the solidified metal of the plug to the inner surface of the well, thereby forming an anchoring of the plug relative to the well. Hence, while many prior art plugs have separate anchoring elements and sealing elements, the present plug has one element providing both the anchoring function and the sealing function.

It should be noted that the above sealing elements are not providing a sealing function with respect to well fluids—there will typically be small gaps between the inner surface of the well and the outer surface of the sealing elements when the plug is in the intermediate state. However, as the sealing elements are exposed to well fluids, they will have the same temperature as the well temperature. Hence, the relatively smaller amounts of molten metal which flows into the small gaps between the inner surface of the well and the outer surface of the sealing elements will be solidify and form a barrier in these gaps. Hence, the purpose of the sealing elements is to contain the molten metal, i.e. to prevent the molten metal to flow down into the well.

In the intermediate state, in which the two sealing elements are radially expanded into contact with the well, it will also be achieved that the longitudinal axis of the plug will be aligned with the longitudinal axis of the well.

The term "wedging surface" is used herein to describe a surface which, when moved towards another "wedging surface", will wedge the sealing element radially outwards. It should be noted that both of the wedging surfaces may have an acute angle with respect to a radial plane. However, it is also possible that one of the surfaces is oriented in the radial plane while the other one of the surfaces is provided with an acute angle with respect to the radial plane.

The term "upper", "above", "lower", "below" etc. are used herein as terms relative to the well. Parts referred to as "upper" or "above" are relatively closer to the top of the well than the parts referred to as "lower" or "below", which are relatively closer to the bottom of the well, irrespective of the well being a horizontal well, a vertical well or an inclining well.

The present invention also relates to a method for setting a downhole millable permanent plug in a downhole well, wherein the method comprises the steps of:

- lowering the plug to a desired location in the downhole well;
- expanding a first sealing element of the plug radially into contact with the well;
- expanding a second sealing element of the plug radially into contact with the well at a longitudinal distance from the first sealing element;
- supplying molten metal in an compartment outside of a mandrel of the plug and longitudinally between the first sealing element and the second sealing element;
- allowing the molten metal to solidify.

In one aspect, the step of supplying molten metal is comprising the steps of:

- melting a metal body provided radially outside of the mandrel longitudinally between the first sealing element and the second sealing element.

In one aspect, the method further comprises the step of:

- reducing the longitudinal distance between the first sealing element and the second sealing element when the molten metal is present in the compartment outside of the mandrel of the plug and longitudinally between the first sealing element and the second sealing element.

DETAILED DESCRIPTION OF THE INVENTION

Figure 1B:
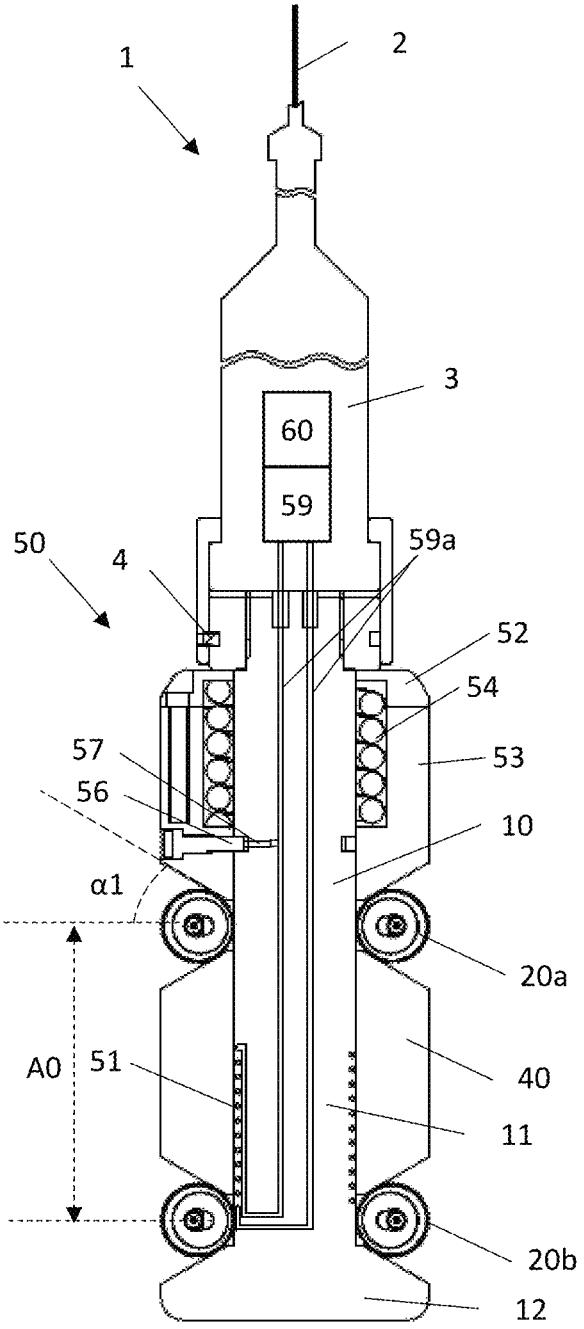

Embodiments of the present invention will now be described in detail with reference to the enclosed drawings, wherein:

FIG. 1*a* shows a side view of the permanent plug in the run state;

FIG. 1*b* shows a cross sectional side view of the permanent plug in FIG. 1*a;*

Figure 2A:
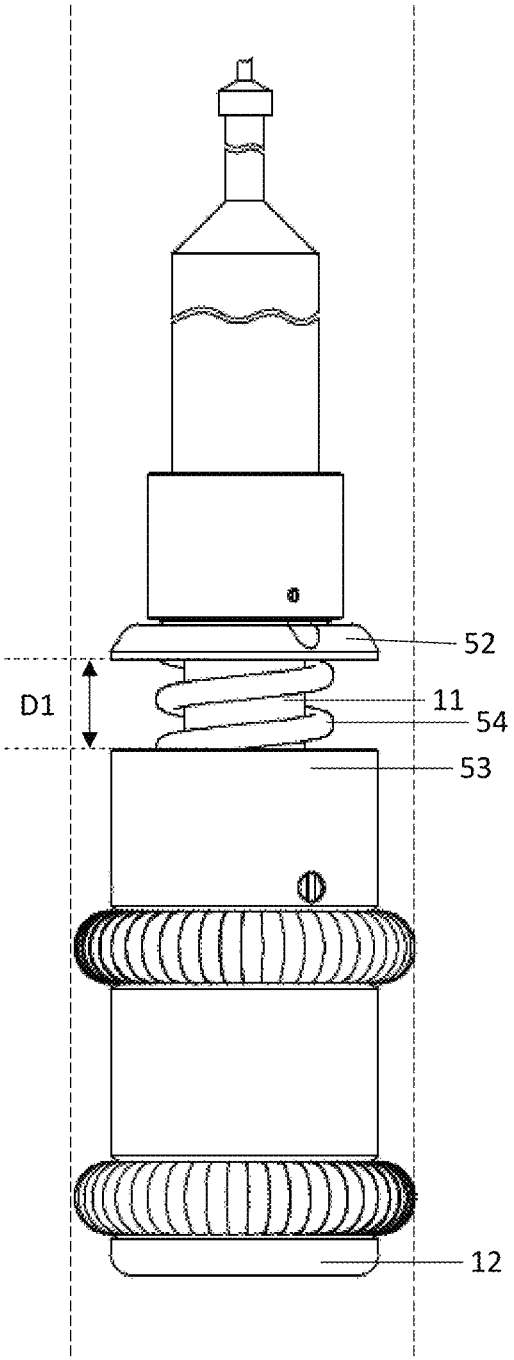
Figure 2B:
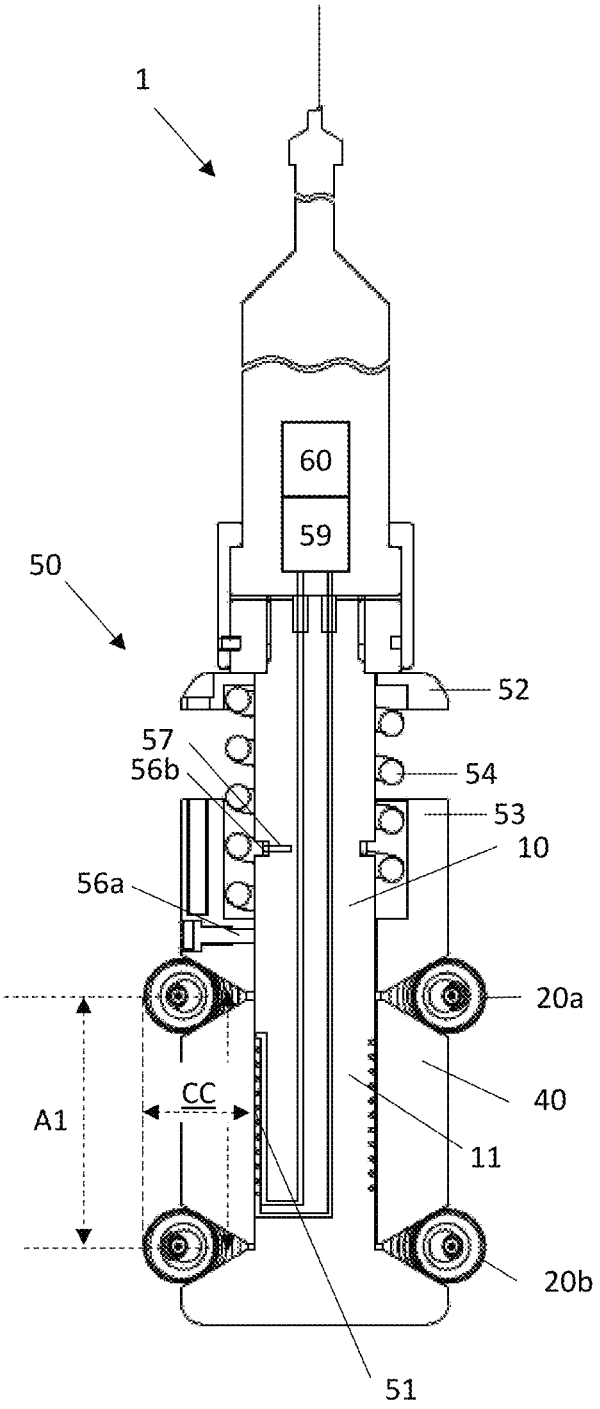

FIG. 2*a* shows a side view of the permanent plug in the intermediate state;

FIG. 2*b* shows a cross sectional side view of the permanent plug in FIG. 2*a;*

Figure 3A:
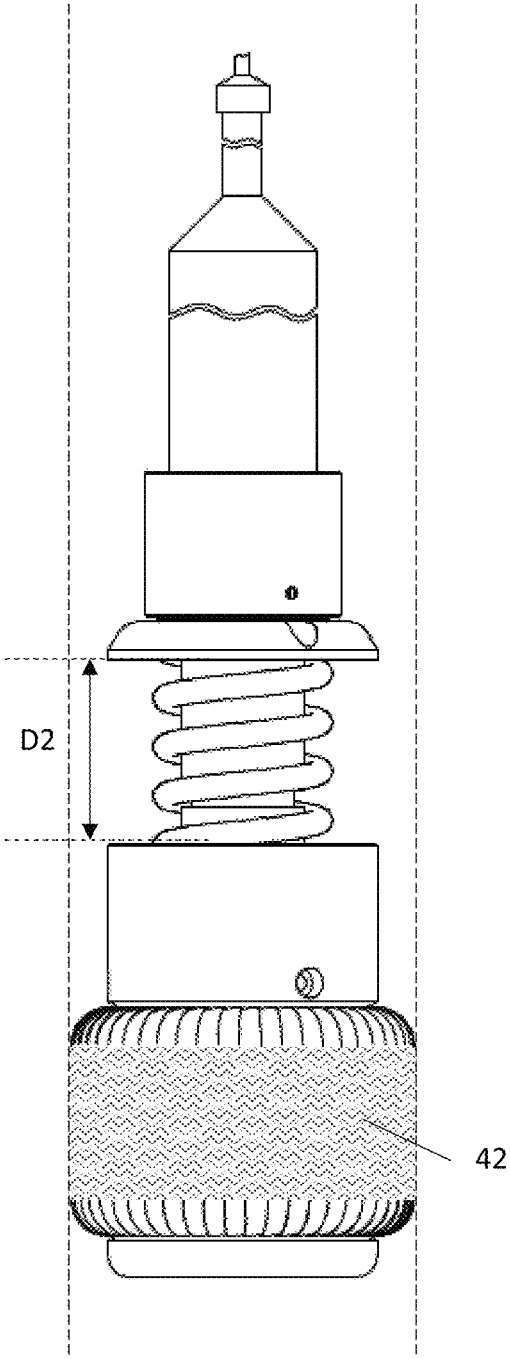
Figure 3B:
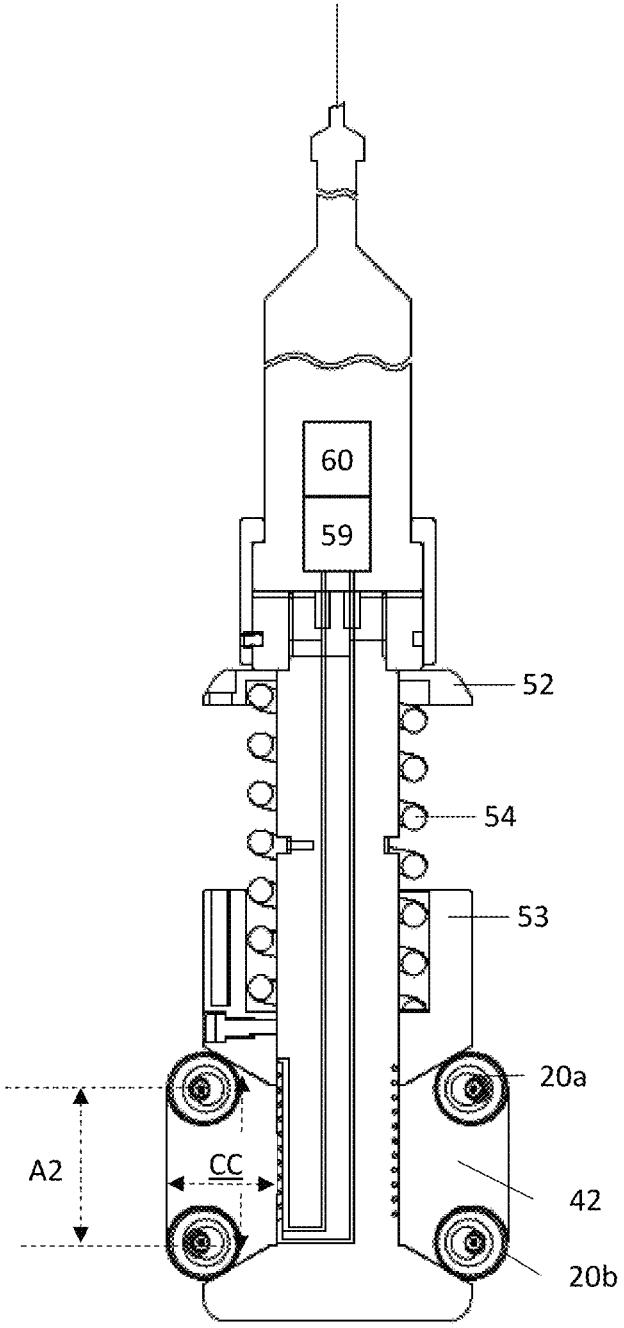

FIG. 3*a* shows a side view of the permanent plug in the set state;

FIG. 3*b* shows a cross sectional side view of the permanent plug in FIG. 3*a;*

Figure 5C:
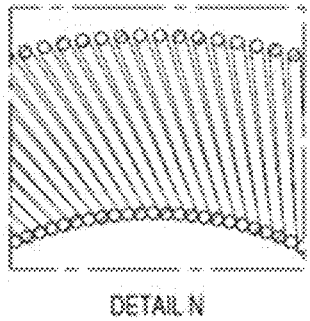
Figure 5A:
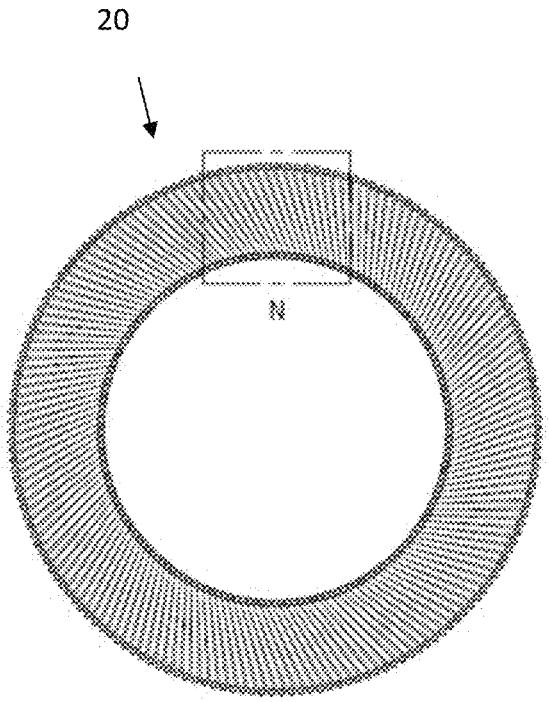
Figure 5B:
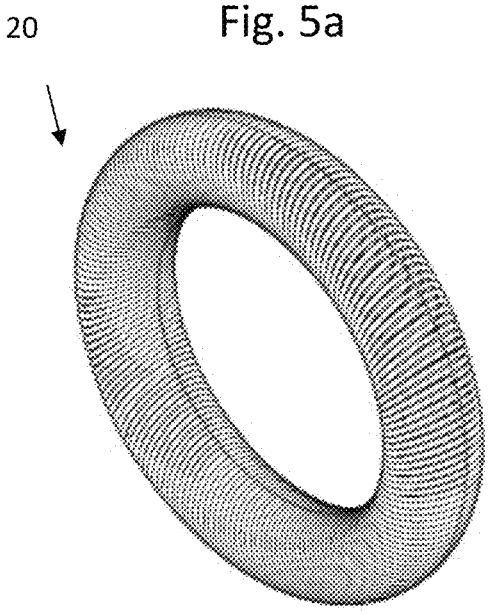
Figure 6A:
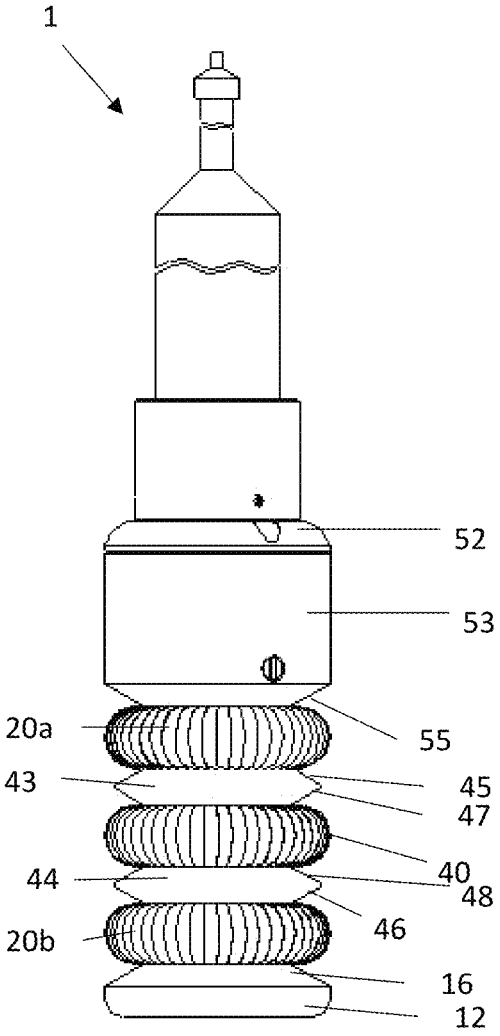
Figure 6B:
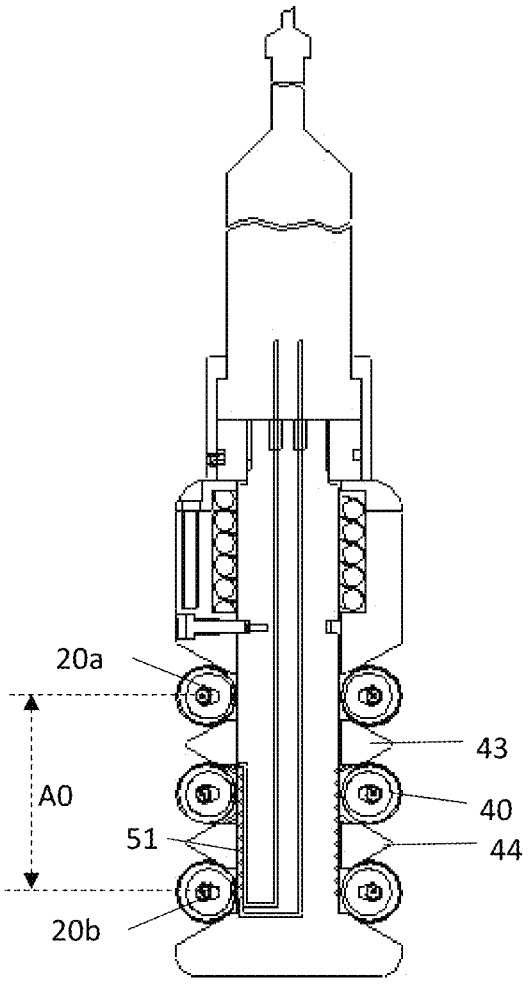
Figure 7A:
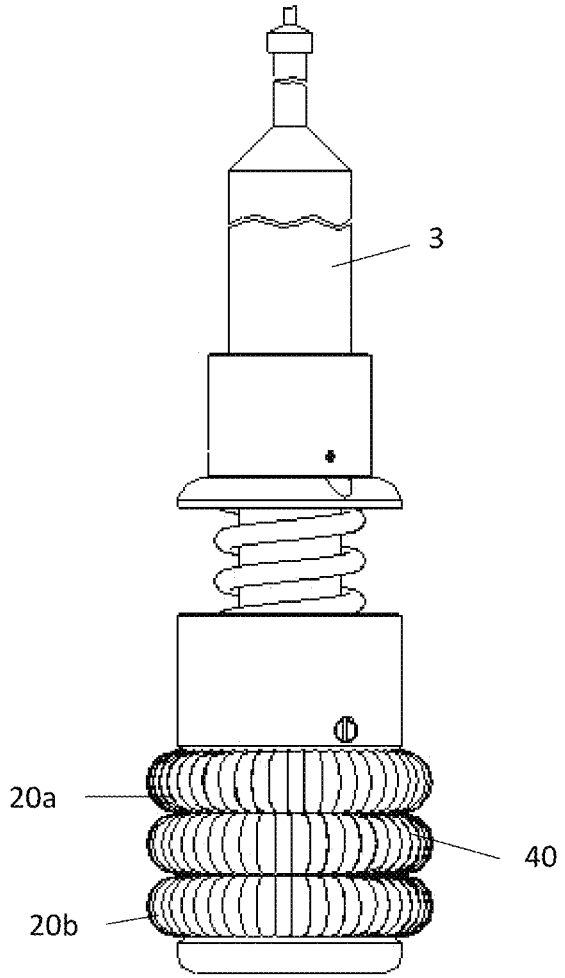
Figure 7B:
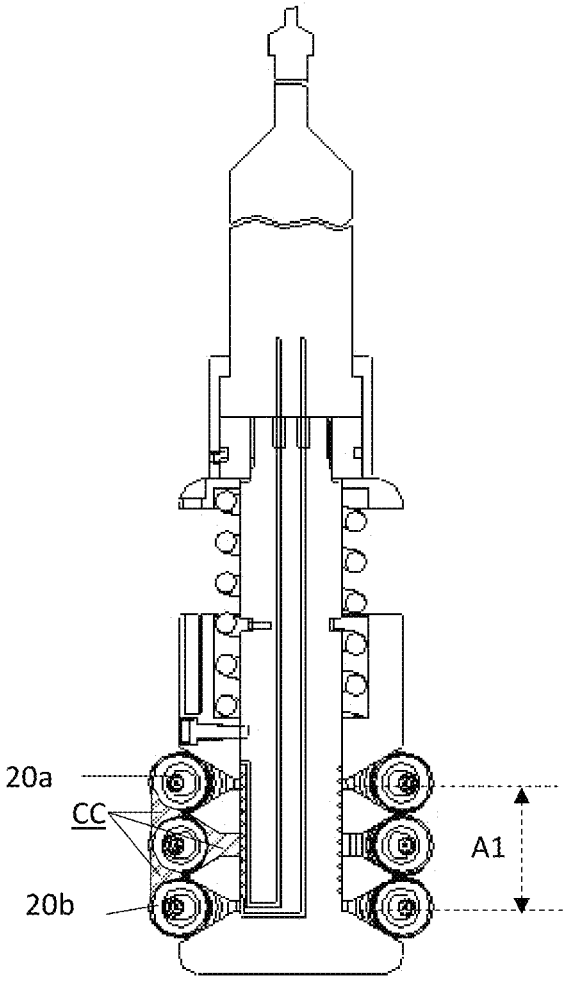
Figure 8A:
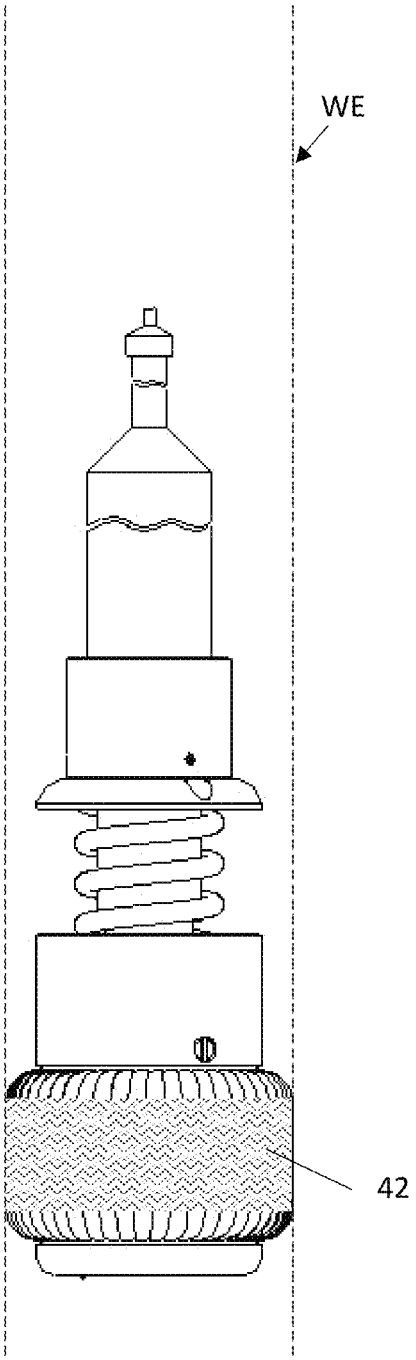
Figure 8B:
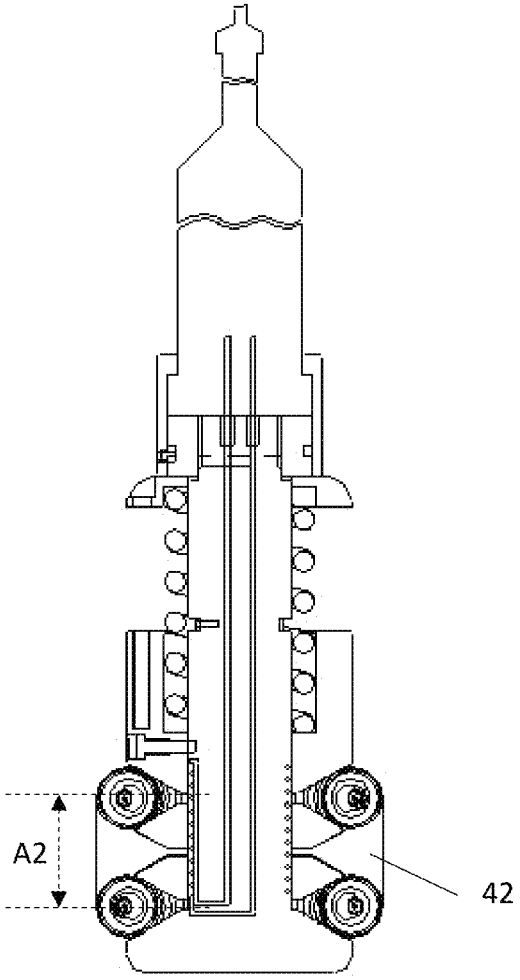

FIG. 4*a-d* illustrate details of the interconnected chain elements forming the first embodiment of the first sealing element and/or the second sealing element;

FIG. 5*a-c* illustrates an alternative embodiment of the first sealing element and/or the second sealing element;

FIG. 6*a* shows a side view of an alternative permanent plug in the run state;

FIG. 6*b* shows a cross sectional side view of the alternative permanent plug;

FIG. 7*a* shows a side view of the alternative permanent plug in the intermediate state;

FIG. 7*b* shows a cross sectional side view of the alternative permanent plug;

FIG. 8*a* shows a side view of the alternative permanent plug in the set state;

FIG. 8*b* shows a cross sectional side view of the alternative permanent plug.

FIRST EMBODIMENT

Initially, it is referred to FIG. 1*a* and FIG. 1*b*, where a well WE is indicated with two parallel dashed lines. It is also shown that a downhole millable permanent plug 1 has been lowered into the well WE. In the description below, the downhole millable permanent plug 1 is referred to as the plug 1. In FIG. 1*a* it is shown that the plug 1 has a longitudinal axis I-I referred to as a longitudinal or axial direction. The direction perpendicular to the longitudinal direction is referred to as a radial direction.

The plug 1 has different states: a run state, an intermediate state and a set state.

These states will be described in detail with respect to the operation of the plug 1 further below. First, the different parts of the plug 1 will be described in detail.

The plug 1 comprises an upper housing 3 having a wire connection interface connected to a wire 2 used to lower the plug 1 into the well WE.

The plug 1 further comprises a mandrel 10. In the present embodiment, the mandrel 10 is releasably connected below the upper housing 3 by means of a shear pin 4. Hence, after setting the plug 1, the upper housing 3 may be released to topside by pulling the wire 2, causing the shear pin 4 to shear off. Hence, the upper housing 3 and the components within the upper housing 3 can be considered as a setting tool for setting the plug 1 in the well WE.

The mandrel 10 comprises a cylindric main section 11 and a lower collar 12 protruding radially from the lower end of the cylindric main section 11.

The Metal Body 40

The plug 1 further comprises a metal body 40 provided radially outside of the cylindric main section 11 of the mandrel 10. In the present embodiment, the metal body 40 is longitudinally displaceable relative to the cylindric main section 11 of the mandrel 10.

The metal may be a bismuth metal or a bismuth alloy. Bismuth is a metal whose volume is larger when solidified than when molten. In other words, the density of the metal in liquid form is larger than the density of the metal in solid form. In addition, it should be noted that bismuth has a relatively low melting temperature, the melting temperature is approximately 270° C. The melting temperature of the metal body is therefore considerably lower than the melting temperature of the housing metal. The housing metal of the present invention is made of cast iron (melting point approximately 1200° C.), cast steel (melting point approximately 1400° C.-1550° C.), i.e. relatively cheaper metals compared with high grade steel metals used in the above-mentioned prior art. It should be noted that also high grade steel metals may be used for the housing. In some applications, high temperature composite materials may be used for the housing.

Alternatively, the metal is another metal or metal alloy whose volume is larger when solidified than when molten and with a melting temperature of the metal body lower than the melting temperature of the mandrel metal. Other such metals are germanium (melting point 940° C.), gallium (melting point 30° C.) or alloys thereof.

One example of a bismuth alloy is the so-called lead-bismuth eutectic alloy comprising 44.5% lead and 55.5% bismuth, having a melting point of 123.5° C.

Other lead/bismuth alloys are also suitable.

Another example of bismuth alloys is tin/bismuth alloys or cupper/bismuth alloys, which will increase the melting temperature to a temperature above the melting temperature of bismuth alone. Such alloys may be preferred for example in high pressure and/or high temperature wells.

It should be noted that suitable alloys may comprise more than two metals.

In the present embodiment, the metal body 40 is a metal alloy of bismuth and lead, where the melting temperature of the alloy is ca 40° C. higher than the expected well temperature at the desired setting location. As an example, if the expected well temperature is 90° C. at the desired setting depth, then an alloy having a melting temperature of 130° C. is used as the metal body 40. Hence, the energy needed to melt the metal body 40 can be limited.

The First Sealing Element 20*a* and the Second Sealing Element 20*b*

The plug 1 further comprises a first sealing element 20*a* and a second sealing element 20*b*. The first sealing element 20*a* is provided radially outside of the mandrel 10, above the metal body 40. The second sealing element 20*b* is also provided radially outside of the mandrel 10, but below the metal body 40. Hence, there is a longitudinal distance between the first sealing element 20*a* and the second sealing element 20*b* indicated as A0 in FIG. 1*b*, A1 in FIG. 2*b* and A2 indicated in FIG. 3*b*.

The first sealing element 20*a* and the second sealing element 20*b* are shown in detail in FIG. 4*a*-FIG. 4*d* as a sealing ring 20. The sealing ring 20 comprises a plurality of thimble-shaped elements 30 inserted into each other to form a torus. When viewed from the side as in FIG. 4*b*, each thimble-shaped element comprises an outwardly curved area 32, an inwardly curved area 33 and possibly a straight area 31 between the areas 32, 33. The outwardly curved area 32 of one element is inserted into the inwardly curved area 33 of the adjacent element. The thimble-shaped elements 30 are known from US2014/0190684 (Interwell Technology AS), where a plugging device is described having a sealing element made of an elastomeric material, where the thimble-shaped elements are incorporated into the elastomeric material. The purpose of the thimble-shaped elements in the above publication is used to prevent or at least partially reduce extrusion of the elastomeric material in situations where there is a large pressure difference over the plug. Here, it is described that a wire may or may not be inserted through an opening 34 of the elements.

In the present sealing ring 20, the thimble-shaped elements 30 are connected to each other by means of a connection element 35 inserted through the respective bores 34. Here, the connection element 34 has the purpose of biasing the sealing element 20 to its radially retracted state. In FIG. 4*b*, it is shown that the connection element 35 is a spiral spring. Alternatively, the connection element 35 may be an elastic wire for biasing the sealing ring 20 towards the radially retracted state.

The thimble-shaped elements 30 are preferably made of a metal or a metal alloy. They may be coated with a high-temperature polymer. Alternatively, the thimble-shaped elements 30 are made of a ceramic or another suitable heat-resistant material. It should be noted that the melting point of the metal or metal alloy of the sealing elements are higher than the melting point of the metal body 40.

Wedging Surfaces

The plug comprises a number of wedging surfaces. A wedging surface is here referring to a surface being in contact with the sealing rings 20 forming the first sealing element 20*a* and the second sealing element 20*b*, and where relative movement between two wedging surfaces are pressing or wedging the sealing ring 20 radially out towards the inner surface of the well WE.

Here, the connection element 35 will be extended, and the distance between each thimble-shaped element 30 will increase. As there are many thimble-shaped elements 30, the distance between each thimble-shaped element 30 will be relatively small.

In the lower end of the second spring support 53, a first wedging surface 55 is provided.

In the upper end of the metal body 40, a second wedging surface 45 is provided.

In the lower end of the metal body 40, a third wedging surface 46 is provided.

In the upper end of the lower collar 12 of the mandrel 10, a fourth wedging surface is provided.

The first wedging surface 55 and the second wedging surface 45 are together forming a wedge-shape, wherein the first sealing element 20*a* is provided between the first wedging surface 55 and the second wedging surface 45. As indicated an FIG. 1*b*, the first wedging surface 55 has an angle $\alpha 1$ of ca 30-450 with respect to a radial plane, the radial plane being perpendicular to the longitudinal axis. Relative longitudinal displacement between the first wedging surface 55 and the second wedging surface 45 towards each other will radially expand the first sealing element 20*a*.

Similarly, the third wedging surface 46 and the fourth wedging surface 16 are together forming a wedge-shape, wherein the second sealing element 20*b* is provided between a third wedging surface 46 and a fourth wedging surface 16. Relative longitudinal displacement between the third wedging surface 46 and the fourth wedging surface 16 towards each other will radially expand the second sealing element 20*b*.

The Setting System 50

The setting system 50 used to set the plug 1 will now be described.

In FIG. 1*a* and FIG. 1*b*, it is shown that the setting system 50 comprises a first spring support 52 provided radially outside of the cylindric main section 11 of the mandrel 10. The first spring support 52 is secured to the mandrel 10. It is further shown a second spring support 53 provided radially outside of the cylindric main section 11 of the mandrel 10. The second spring support 53 is longitudinally displaceable relative to the mandrel 10. However, in FIG. 1*b*, it is shown that the second spring support 53 is releasably secured to the mandrel 10 by means of a meltable locking element 56. A heater, hereinafter referred to as an auxiliary heater 57, is provided adjacent to the meltable locking element 56 for melting of the meltable locking element 56.

The setting system 50 comprises a spring 54 biased between the first spring support 52 and the second spring support 53. The spring 54 is also located radially outside of the main section 11 of the mandrel 10. As shown in FIG. 1*a* and FIG. 1*b*, the first spring support 52 and the second spring support 53 is in contact with each other, i.e. the longitudinal distance D0 between the first spring support 52 and the second spring support 53 is 0 mm. Consequently, the first spring support 52 and the second spring support 53 together forms a housing protecting the spring 54.

The setting system 50 further comprises a main heater 51 which purpose is to melt the metal body 40. The main heater 51 may be integrated in the mandrel 10 or may be provided on the outside of the mandrel 10. The main heater 51 is provided radially inside and in the proximity of the metal body 40.

The setting system 50 further comprises a control circuit 59 and a battery 60 for controlling and supplying electric energy to the main heater 51 and the auxiliary heater 57 via electric wires 59*a*.

Operation of the Plug

The run state, in which the plug 1 is run or lowered into the well, is shown in FIGS. 1*a* and 1*b*. In this run state, the first sealing element 20*a* and the second sealing element 20*b* are radially retracted.

As shown, the distance DO between the upper spring support 52 and the second spring support 53 is 0 mm. The distance between the first sealing element 20*a* and the second sealing element 20*b* is indicated as a distance A0.

When the plug 1 has been lowered to the desired location in the well WE, the setting operation is starting by supplying electric energy to the auxiliary heater 57, which melts the locking element 56. The second spring support 53 is no longer connected to the mandrel 10, and the spring 54 presses the second spring support 53 a distance D1 downwardly and away from the first spring support 52. Hence, the distance D1 is larger than the distance D0.

The movement of the second spring support 53 will move the first sealing element 20*a* downwardly relative to the mandrel 10, and will move the metal body 40 downwardly relative to the mandrel 10. At the same time, the first sealing element 20*a* and the second sealing element 20*b* will be wedged in a radial direction into their radially expanded or set state. The distance between the first sealing element 20*a* and the second sealing element 20*b* is in FIG. 2*b* indicated as a distance A1 being smaller than the distance A0.

In FIG. 2*b* it is also shown that the locking element 56 is separated into two parts 56*a*, 56*b*. It is further shown in FIG. 2*a* that a closed compartment CC has been created longitudinally between the first sealing element 20*a* and the second sealing element 20*b* and radially between the outside of the main mandrel section 11 and the inside of the well WE.

The plug 1 is now in its intermediate state. The auxiliary heater 57 may now be turned off.

The next step of the setting operation is now started by supplying electric energy to the main heater 51, which starts the melting of the metal body 40. The molten metal will allow the spring 54 to push the second spring support 53 and hence also the first sealing element 20*a* downwardly, thereby reducing the height of the closed compartment CC. As shown in FIG. 3*a*, the spring 54 has here pressed the second spring support 53 a distance D2 downwardly and away from the first spring support 52, where the distance D2 is larger than the distance D1. The distance between the first sealing element 20*a* and the second sealing element 20*b* is in FIG. 3*b* indicated as a distance A2 being smaller than the distance A1 in FIG. 2*b*.

After a period of time, when the entire metal body 40 has been melted, it can be assumed that the entire or almost the entire compartment CC is filled with molten metal.

The main heater 51 may now be turned off, causing the molten metal to solidify into contact with the well WE and forming a subsequent metal body indicated as 42 in FIG. 3*a* and FIG. 3*b*. During solidification, the metal will expand, as the volume is larger when solidified than when molten. The expanding properties of the metal during solidification will exert a force from the outer surface of the solidified metal of the plug to the inner surface of the well, thereby forming an anchoring of the plug relative to the well in addition to preventing fluid flow between the well WE above the plug 1 and the well WE below the plug 1.

The plug 1 is now in its set state.

In a final step, the upper housing 3 may be retrieved to the topside of the well by pulling in the wire or by using a pulling tool connected to a fish neck in the top section of the upper housing 3. Hence, the control circuit 59 and the battery 60 of the upper housing 3 may be re-used.

Second Embodiment

It is now referred to FIG. 6*a-b*, FIG. 7*a-b* and FIG. 8*a-b*, wherein a second embodiment of the permanent plug 1 is shown. The second embodiment is in many ways similar to the first embodiment described above, and only differences between the first end second embodiment will be described in detail herein.

In FIG. 6*a* and FIG. 6*b*, the metal body 40 is provided as a plurality of thimble-shaped elements inserted into each other to form a torus, similar to the first sealing element 20*a* and the second sealing element 20*b*. Each thimble-shaped element is here made of the same material as the metal body 40 of the first embodiment. The thimble-shaped elements is also here connected by means of a connection element 35, this connection element 35 may be made of steel or another suitable material.

In addition, the plug 1 here comprises a first ring 43 located between the first sealing element 20*a* and the metal body 40, wherein the second wedging surface 45 is located on the first ring 43 facing towards the first sealing element 20*a* and wherein the first ring 43 comprises a fifth wedging surface 47 facing towards the metal body 40.

In addition, the plug 1 here comprises a second ring 44 located between the metal body 40 and the second sealing element 20*b*, wherein the third wedging surface 46 is located on the second ring 44 facing towards the second sealing element 20*b* and wherein the second ring 44 comprises a sixth wedging surface 48 facing towards the metal body 40.

The first ring 43 and the second ring 44 may be made of the same material as the housing. The first rings 43 and the second ring 44 are longitudinally displaceable relative to the cylindric main section 11 of the mandrel 10.

It is now referred to FIGS. 7*a* and 7*b*, showing the intermediate state. Here, the first sealing element 20*a*, the second sealing element 20*b* and the metal body 40 has been radially expanded due to the wedging surfaces being longitudinally displaced towards each other, thereby wedging the first sealing element 20*a*, the second sealing element 20*b* and the metal body 40 radially outwards. Also here, a closed compartment CC (indicated as a hatched area in FIG. 7*b*) has been created longitudinally between the first sealing element 20*a* and the second sealing element 20*b* and radially between the outside of the main mandrel section 11 and the inside of the well WE.

It is now referred to FIGS. 8*a* and 8*b*. Electric energy is now supplied to the main heater 51, which starts the melting of the metal body 40. The molten metal will allow the spring 54 to push the second spring support 53 and hence also the first sealing element 20*a* downwardly, thereby reducing the height of the closed compartment CC. The distance between the first sealing element 20*a* and the second sealing element 20*b* is in FIG. 8*b* indicated as a distance A2 is also here being smaller than the distance A1 in FIG. 7*b*. It can also be seen that the distance between the rings 43, 44 is shorter in FIG. 8*b* than in FIG. 7*b*.

After a period of time, when the entire metal body 40 has been melted, it can be assumed that the entire or almost the entire compartment CC is filled with molten metal.

The main heater 51 may now be turned off, causing the molten metal to solidify into contact with the well WE and forming a subsequent metal body indicated as 42 in FIG. 8*a*. During solidification, the metal will expand, as the volume is larger when solidified than when molten.

Alternative Embodiments

In one alternative, the mandrel 10 is fixed to the upper housing 3. Here, the upper housing 3 is not retrieved topside after setting of the plug, only the wire 2 is released from the upper housing 3 and retrieved topside.

In yet an alternative, the control circuit 59 and the battery 60 are located topside, where electric energy is supplied to the main heater 51 and the auxiliary heater 57 via the wire 2.

In yet an alternative, the first sealing element 20*a* and the second sealing element 20*b* does not comprise as plurality of thimble-shaped elements inserted into each other to form a torus. Instead, the first sealing element 20*a* and the second sealing element 20*b* are made as a coiled spring, preferably as a canted coiled spring. Preferably, the coiled spring or canted coiled spring comprises a core in the form of a smaller coiled spring or a canted coiled spring, or a core in the form of shorter cylindrical pin elements. The canted coiled spring is considered known for a person skilled in the art from WO2021043582. Also the canted coiled spring will have small gaps when radially expanded into contact with the inner surface of the well. However, also these small gaps will be sealed by solidified molten metal flowing into these small gaps due to the lower surrounding temperatures in the well.

The invention claimed is:

1. A downhole millable permanent plug for permanently sealing of a downhole well, the downhole millable permanent plug comprises:

a mandrel having a longitudinal axis;

a first sealing element provided radially outside of the mandrel;

a second sealing element provided radially outside of the mandrel at a distance from the first sealing element;

a metal body provided radially outside of the mandrel between the first sealing element and the second sealing element; and a setting system comprising a heater for melting the metal body;

wherein the downhole millable permanent plug is configured to be in:

a run state, in which the first sealing element and the second sealing element are radially retracted;

an intermediate state, in which the first sealing element and the second sealing element are radially expanded into contact with the downhole well; and a set state, in which the metal body has been melted by the heater and subsequently solidified into contact with the downhole well;

wherein the setting system comprises:

a first spring support secured to the mandrel, a second spring support longitudinally displaceable relative to the mandrel, and a spring for moving the second spring support relative to the first spring support;

wherein the second spring support is releasably secured to the mandrel in the run state;

wherein the second spring support is released in the intermediate state, causing the second spring support to be longitudinally displaced a first distance from the first spring support relative to the mandrel; and wherein the first sealing element and the second sealing element are radially expanded into contact with the downhole well by the longitudinal displacement of the second spring support.

2. The downhole millable permanent plug according to claim 1, wherein the second spring support is allowed to be longitudinally displaced a second distance from the first spring support relative to the mandrel when the metal body has been melted by the heater and wherein the second distance is longer than the first distance.

3. The downhole millable permanent plug according to claim 1, wherein the second spring support is releasably secured to the mandrel by means of a meltable locking element in the run state.

4. The downhole millable permanent plug according to claim 3, wherein the setting system comprises an auxiliary heater for melting the meltable locking element.

5. The downhole millable permanent plug according to claim 1, wherein the metal body comprises a metal or a metal alloy whose volume is larger when solidified than when molten.

6. The downhole millable permanent plug according to claim 5, wherein the metal is bismuth or the metal alloy is a bismuth alloy.

7. The downhole millable permanent plug according to claim 1, wherein the metal body comprises a metal or a metal alloy having a melting temperature lower than the melting temperature of the mandrel.

8. The downhole millable permanent plug according to claim 1, wherein the first sealing element and/or the second sealing element comprise a plurality of thimble-shaped elements inserted into each other to form a torus.

9. The downhole millable permanent plug according to claim 1, wherein the heater and/or an auxiliary heater are integrated in the mandrel.

10. A downhole millable permanent plug for permanently sealing of a downhole well, the downhole millable permanent plug comprises:

a mandrel having a longitudinal axis;

a first sealing element provided radially outside of the mandrel;

a second sealing element provided radially outside of the mandrel at a distance from the first sealing element;

a metal body provided radially outside of the mandrel between the first sealing element and the second sealing element; and a setting system comprising a heater for melting the metal body;

wherein the downhole millable permanent plug is configured to be in:

a run state, in which the first sealing element and the second sealing element are radially retracted;

an intermediate state, in which the first sealing element and the second sealing element are radially expanded into contact with the downhole well; and a set state, in which the metal body has been melted by the heater and subsequently solidified into contact with the downhole well;

wherein the first sealing element is provided between a first wedging surface and a second wedging surface and wherein the first wedging surface and the second wedging surface are compressed towards each other to radially expand the first sealing element.

11. The downhole millable permanent plug according to claim 10, wherein the first wedging surface is provided on a second spring support and wherein the second wedging surface is provided on the metal body.

12. The downhole millable permanent plug according to claim 10, wherein the second sealing element is provided between a third wedging surface and a fourth wedging surface and wherein relative longitudinal displacement between the third wedging surface and the fourth wedging surface towards each other radially expands the second sealing element.

13. The downhole millable permanent plug according to claim 12, wherein the third wedging surface is provided on the metal body, wherein the fourth wedging surface is provided on the mandrel, and wherein the metal body is longitudinally displaceable relative to the mandrel.

14. The downhole millable permanent plug according to claim 10, wherein the metal body comprises a metal or a metal alloy whose volume is larger when solidified than when molten.

15. The downhole millable permanent plug according to claim 14, wherein the metal is bismuth or the metal alloy is a bismuth alloy.

16. The downhole millable permanent plug according to claim 10, wherein the metal body comprises a metal or a metal alloy having a melting temperature lower than the melting temperature of the mandrel.

17. The downhole millable permanent plug according to claim 10, wherein the heater and/or an auxiliary heater are integrated in the mandrel.

18. A method for setting a downhole millable permanent plug in a downhole well, the method comprises:

lowering the downhole millable permanent plug to a desired location in the downhole well, wherein the downhole millable permanent plug comprises:

a mandrel having a longitudinal axis, a first sealing element provided radially outside of the mandrel, and a second sealing element provided radially outside of the mandrel at a distance from the first sealing element;

expanding the first sealing element radially into contact with the downhole well;

expanding the second sealing element radially into contact with the downhole well at a longitudinal distance from the first sealing element;

melting a metal body, in a compartment, provided radially outside of the mandrel longitudinally between the first sealing element and the second sealing element; and allowing the melted metal body to solidify;

wherein the method further comprises reducing the longitudinal distance when the melted metal body is present in the compartment.

* * * * *